US005575037A

United States Patent [19]

Tolle et al.

[11] Patent Number: 5,575,037

[45] Date of Patent: Nov. 19, 1996

[54] DOOR HINGE ASSEMBLY, STRUCTURALLY UNITED WITH A DOOR LATCH, FOR CAR DOORS

[75] Inventors: Karl-Heinz Tolle, Wuppertal; Norbert Lotz, Leichlingen, both of Germany

[73] Assignee: Ed Scharwachter GmbH & Co., KG, Remsaheld, Germany

[21] Appl. No.: 524,687

[22] Filed: Sep. 7, 1995

[30] Foreign Application Priority Data

Sep. 8, 1994 [DE] Germany ..... 44 32 022.1

[51] Int. Cl.[6] ..... E05D 11/10

[52] U.S. Cl. ..... 16/334; 16/352; 16/308; 16/237; 16/262

[58] Field of Search ..... 16/334, 327, 331, 16/332, 333, 343, 344, 352, 371, 308, 382, 235, 237, 254, 261, 262, DIG. 43

[56] References Cited

U.S. PATENT DOCUMENTS

| | | | |
|---|---|---|---|
| 3,969,789 | 7/1976 | Wize | 16/334 |
| 4,677,708 | 7/1987 | Streett | 16/334 |
| 4,720,895 | 1/1988 | Peebles | 16/344 |
| 4,807,331 | 2/1989 | Calucci | 16/262 |
| 4,864,687 | 9/1989 | Calcaterra et al. | 16/237 |
| 5,444,894 | 8/1995 | Heiler | 16/344 |

FOREIGN PATENT DOCUMENTS

| | | |
|---|---|---|
| 3605434A1 | 8/1987 | Germany . |
| 2058903A | 4/1981 | United Kingdom . |

*Primary Examiner*—Chuck Y. Mah
*Attorney, Agent, or Firm*—Cushman, Darby & Cushman

[57] ABSTRACT

Disclosed is a door hinge assembly for car doors which includes a rotating bar door latch and two hinge wings which pivotably connected to each other by a hinge pin. A first hinge wing may be fastened to the door body and the second hinge wing may be detachably fastened to the door pillar. A catch device for the door latch retarding and securing member, which is disposed on the one hinge wing, is disposed on a lateral wall of the other hinge wing. The second hinge wing is formed by a folded sheet metal part and can be fastened to the door pillar by means of an intermediate part provided with a contact face for the second hinge wing. The intermediate part includes a projection which is aligned perpendicular to the hinge axis receives the hinge pin. The second hinge wing is detachably fastened to the door pillar a second fastener which effects both the connection of the second hinge wing to the intermediate part and provides the common fastening of intermediate part and second hinge wing to the door pillar. The projection of the intermediate part has an extension that engages the lateral wall of the second hinge wing, providing additional support to counteract the forces that result from the operation of the door latch.

14 Claims, 4 Drawing Sheets

DOOR HINGE ASSEMBLY, STRUCTURALLY UNITED WITH A DOOR LATCH, FOR CAR DOORS

The priority application No. P 44 32 022.1, filed in Germany on Sep. 8, 1994, is hereby incorporated into the present specification by reference.

FIELD OF THE INVENTION

This invention relates to a door hinge for car doors, which is structurally united with a door latch and, in particular, relates to such a door hinge which has two hinge wings pivotably connected to each other by a hinge pin.

BACKGROUND OF THE INVENTION

In modern vehicle construction, the doors are already fastened to the body shell, at least temporarily, in a final alignment and then lacquered together with the body shell. After the common lacquering of body and doors, the doors must be separated once again from the body for the sake of rational operation, on the one hand when installing the internal equipment of the body, e.g. seats, header, dashboard, pedals, and the like, and on the other hand when outfitting the doors themselves, i.e. when installing equipment parts such as window lifter, door lock, and interior covering. After completing equipping of doors and body, the doors are again attached to the vehicle body in the originally established position.

To this end, many embodiments of removable door hinges have already been developed, as follows:

In one kind of removable door hinges both of the hinge wings are durably connected to the door, door pillar, or door placement part associated with them, and the door hinge is separated by lifting the first hinge wing up from the hinge pin. Embodiments of this kind, though, cannot be used for a door hinge which is structurally united with a door latch.

In another version of removable door hinges, the door hinge is inseparable and merely the first hinge wing is detachably fastened on a door placement part, usually of the door pillar, by means of an intermediate part or fastening element. The intermediate part or fastening element is already durably fastened to the door pillar on the body shell in an aligned position. The accompanying hinge wing can then be detachably connected to the intermediate part or fastening element by means of screw bolts. For this version with separable door hinges, it is also already known, primarily for door hinges equipped with door latches, to provide projection on the intermediate part or fastening element a projection which is aligned perpendicular to the hinge axis. The projection is provided with a receiving bore for a longitudinal section of the hinge pin, which projects above the height of the hinge. With separable door hinges, which are embodied in this manner and equipped with a rotating bar door latch, certain problems arise in terms of assembly and in reliable support of the forces resulting from the door latch, if the hinge wing that carries the catch device of the door latch is formed of a suitably folded blank of sheet metal material and at the same time is the hinge wing that is to be detachably connected to the intermediate part or fastening element.

SUMMARY OF THE INVENTION

The object of the invention, therefore, is to provide a detachable fastening structure for a door hinge, which is structurally united with a door latch, whose hinge wing to be detachably fastened on the door pillar is formed by a folded sheet metal material blank, and at the same time carries the catch device of the door latch, without exhibiting the problems noted above.

This objective is obtained by providing a first hinge wing constructed and arranged to be durably fastened to the door body and the second hinge wing is detachably fastenable to the door column. A rotating bar door latch includes a retarding and securing member which is disposed on a free load arm of a C-shaped or S-shaped rotating bar spring that is fixed in a conventional manner on the first hinge wing. A catch device is disposed or embodied on a lateral wall of the second hinge wing and receives the securing member. The lateral wall projects perpendicular to the hinge axis. The second hinge wing is formed entirely by a suitably folded pressed sheet metal part and can be fastened on the door pillar by means of an intermediate part. The intermediate part is fixed durably in a pre-aligned, partially secured position on the door pillar via a first fastening means and is provided with a contact face for the second hinge wing, which face is aligned parallel to the hinge axis, and by means of a second fastening means.

The second hinge wing is detachably fastened to a door pillar by means of a second fastening means, which is embodied by a screw bolt and which effects the connection of the second hinge wing to the intermediate part as well as the common fastening of intermediate part and second hinge wing to the door pillar. A projection of the intermediate part, which overlaps or underlaps the hinge pin, has an extension, which, preferably engages the lateral wall of the second hinge wing, which carries the catch scorings for the door latch, constitutes an additional support for the forces, resulting from the operation of the door latch.

This embodiment of a hinge, and of its detachable fastening in particular, is distinguished in an outstanding manner by the fact that the forces, which result from the operation of the door latch and which occur intermittently are absorbed to a large extent directly by the intermediate part, with the result that on the one hand, the second hinge wing, which comprises a sheet metal material, and its fastening structure or fastening means, are relieved to a large extent of these forces, which occur intermittently and with high force peaks. Apart from the fact that this also makes it easier to embody the hinge wing that carries the catch device for the door latch, a single fastening element, which is embodied as a screw bolt, can be used to fasten the second hinge wing to the intermediate part, and to finally fasten the intermediate part, together with the second hinge wing, to the door pillar. Hand in hand with these advantages, naturally the possibility also arises of combining the apparatus, which now comprises the least possible number of loose component parts, to make a shipping unit by means of a simple clamp, e.g. one made of a plastic material, without component parts which can be lost.

The intermediate part is suitably embodied as a one-piece or compound shaped part and when viewed from above, has a roughly V-shaped outline; one-half of this outline is embodied by its contact face on the door pillar and the other half of this outline is embodied by the projection that overlaps or underlaps the hinge pin, and by its extension that supports the lateral wall of the second hinge wing. Furthermore, the point of the V-shaped outline is disposed in the region of the hinge axis.

In an additional embodiment of the intermediate part, the projection of the intermediate part, adjacent to its contact face, has a bore, which receives an end region of the hinge pin, which protrudes from the second hinge wing, and engages with positive fit, the lateral wall of the second hinge wing, or the wall which carries the catch device of the door latch.

The arrangement of the fastening means and the respective through bores associated with it is appropriately designed in such a way that in the section of the intermediate part that constitutes the contact face, the through bores for the first and the second fastening means are each embodied as a slot bore, a long axis thereof being aligned perpendicular to the hinge axis. At least the through bore, which is associated with the second fastening means, is oversized to receive the shank of the second fastening means. The through bore associated with the first fastening means is disposed in the contact face of the intermediate part, outside its overlapping region with the other hinge wing.

Finally, one more characteristic of the invention is seen in that the second fastening means, which comprises a screw bolt, constitutes the sole fastening means for the second hinge wing, which bolt is aligned perpendicular to the hinge axis, and this bolt is embodied as reaching through the intermediate part and the door pillar. A round bore in the second hinge wing and a slot bore in the intermediate part are associated with the second fastening means.

The invention is described in detail in the following description of an exemplary embodiment shown in the drawings.

DESCRIPTION OF THE PREFERRED EMBODIMENT

Figure 1:
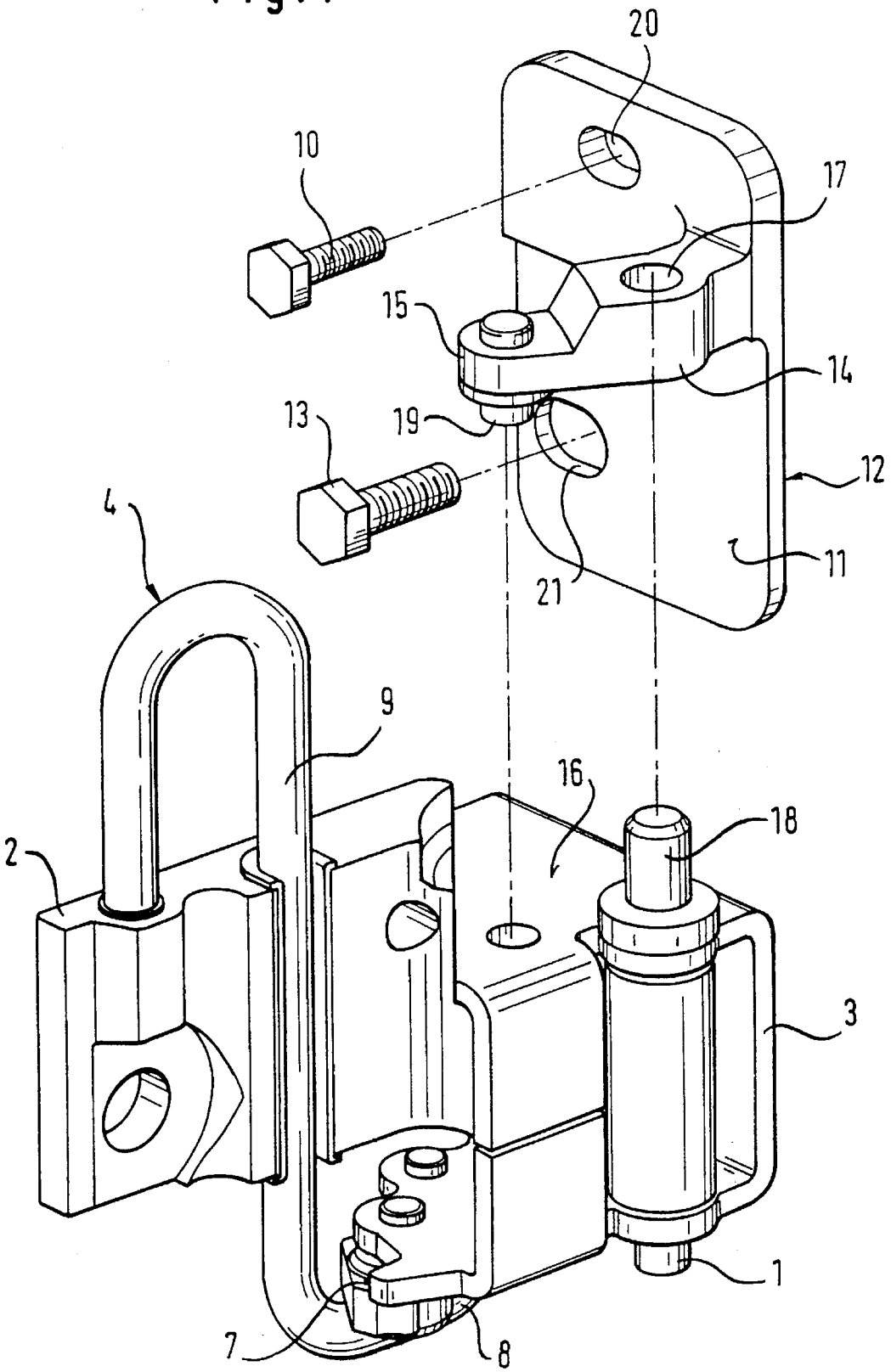
FIG. 1 shows a diagrammatic representation of a car door hinge assembly, which is structurally united with a door latch.
Figure 2:
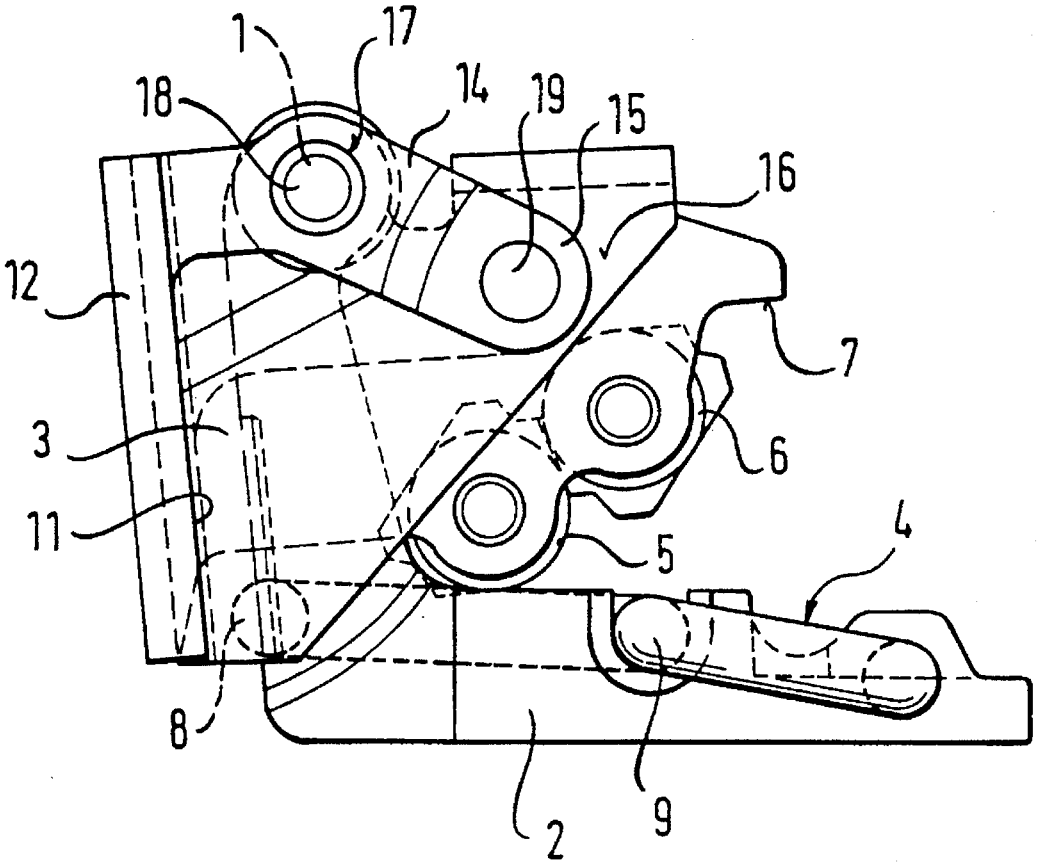
FIG. 2 shows a top view of the car door hinge assembly of the invention.
Figure 3:
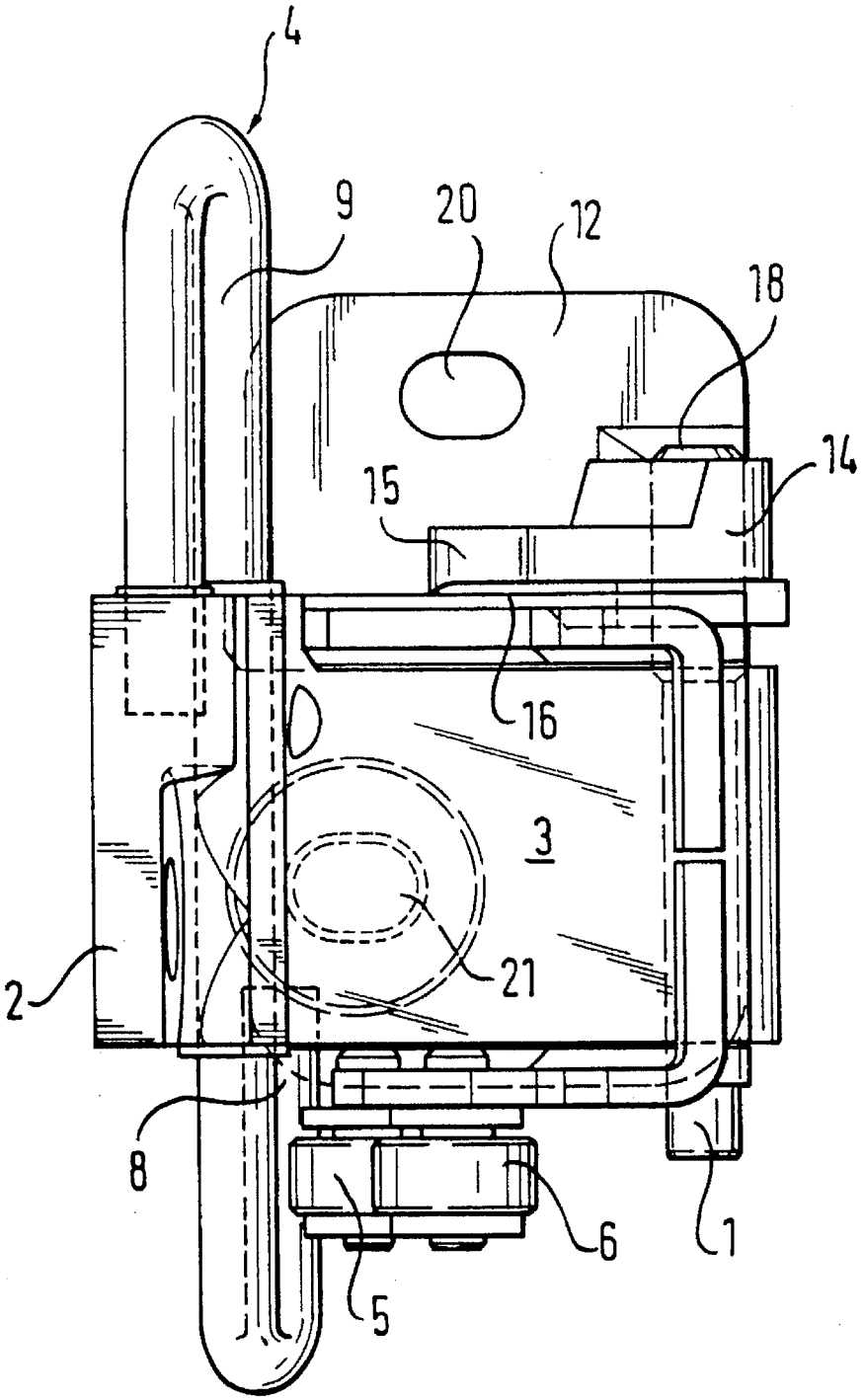
FIG. 3 shows a front view of the car door hinge assembly of FIG. 2.
Figure 4:
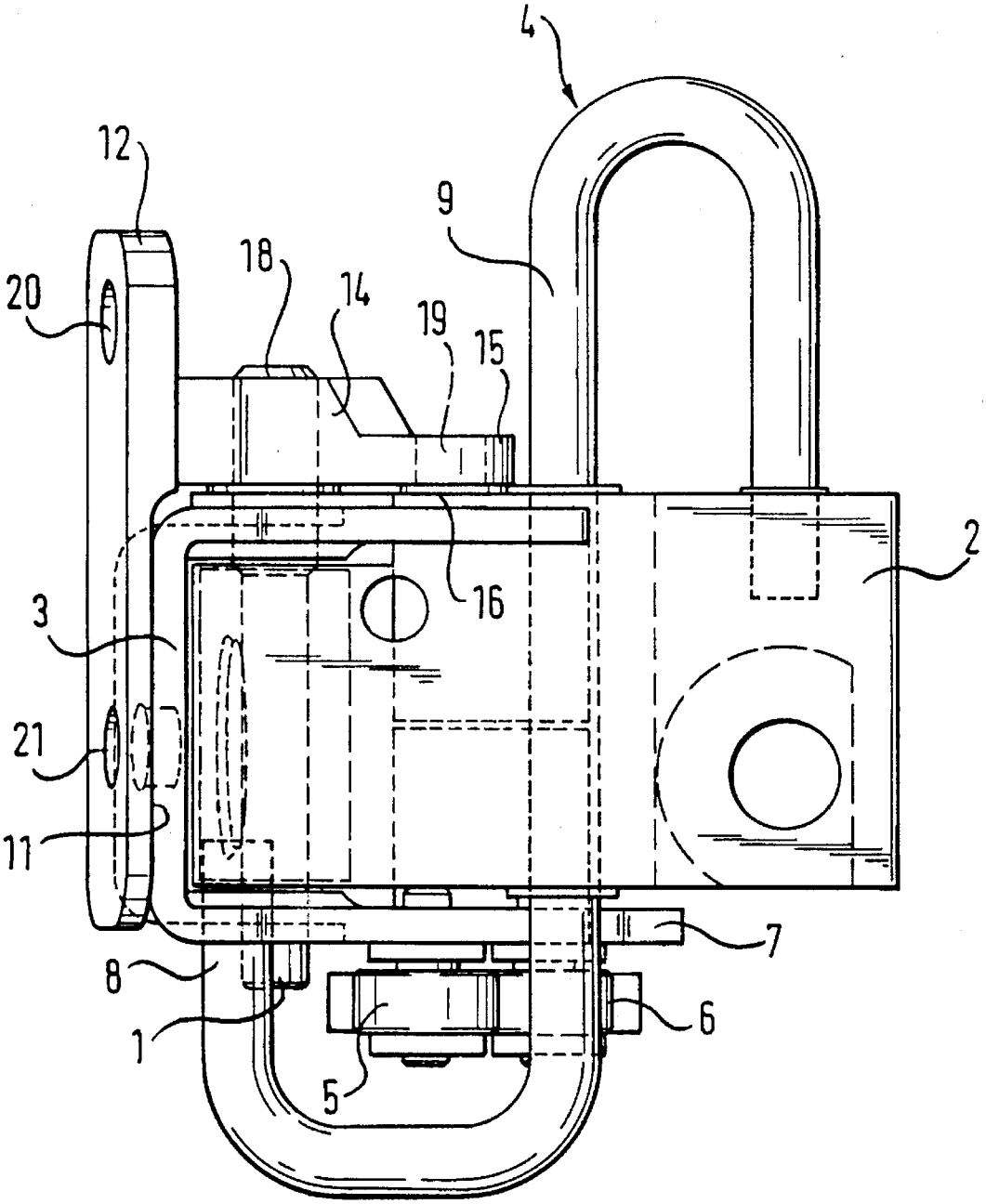
FIG. 4 shows a side view of the car door hinge assembly of FIG. 2.

A door hinge assembly for car doors, shown in FIGS. 1–4, which is structurally united with a door latch, comprises a rotating bar door latch 4 and two hinge wings 2 and 3, which are pivotably connected to each other by a hinge pin 1, of which wing 2 is durably fastened to the door body, not shown in the drawings, and the other wing 3 is detachably fastened to the door pillar or column, likewise not shown in the drawing. A catch device is disposed on a lateral wall 16 of the second hinge wing and comprises two rollers 5 and 6 as well as an end stop 7 which receives the retarding and securing member of the door latch 4. The securing member is embodied by the free load arm 8 of a C-shaped or S-shaped rotating bar spring 9, which is fixed in a conventional manner on the first hinge wing 2. The lateral wall 16 projects perpendicular to a hinge axis defined by the hinge pin 1. The second hinge wing 3 is formed entirely by a suitably folded pressed sheet metal part and can be fastened on the door pillar by an intermediate part 12. Part 12 is fixed durably in a pre-aligned, partially secured position on the door pillar via a first fastening means 10 and via a second fastening means in the form of a screw bolt 13. Intermediate part 12 is provided with a contact face 11 for engaging the hinge wing 3, which face is aligned parallel to the hinge axis. The intermediate part 12 has a projection 14, which is aligned perpendicular to the hinge axis and is aligned at a sharp angle to the plane of the contact face 11, overlapping the hinge pin 1. The projection 14 of the intermediate part 12 has an extension 15 adjoining the lateral wall 16 of the second hinge wing 3, which extension constitutes an additional support for the forces which result from the operation of the door latch 4. The intermediate part 12 is embodied as a one-piece part and when viewed from above, has a roughly V-shaped outline; one half of this outline is embodied by its contact face 11, and the other half of this outline is constituted by the projection 14 and its extension 15. Furthermore, the projection 14 of the intermediate part 12 has a material thickness, which tapers down over its length from its root to its free end. In the projection 14 of the intermediate part 12, adjacent to its contact face 11, a receiving bore 17 is provided for receiving an end region 18 of the hinge pin 1; this end region protrudes from the second hinge wing 3 and engages the lateral wall of the second hinge wing 3 with a positive fit. The extension 15 of the projection 14 engages the lateral wall 16 of the second hinge wing 3 with a positive fit by means of a bolt or peg 19, which is aligned axially parallel to the hinge axis defined by the hinge pin 1. In the exemplary embodiment, the projection/extension 14/15 of the intermediate part 12 engages the lateral wall 16 of the second hinge wing 3 via the peg or bolt 19, in an alignment which lies between the second roller 6 and the opening end stop 7 of the catch device of the door latch.

The through bores 20 and 21 for the first fastening means 10 and the second fastening means 13 in the section of the intermediate part 12, which section constitutes the contact face 11, are each embodied as slot bores with a long axis thereof being aligned perpendicular to the hinge axis. At least the through bore 21 associated with the second fastening means 13 is oversized to accommodate the shank of the second fastening means 13. A round bore 25 in the second hinge wing 3 and the slot 21 in the intermediate part 12 are associated with the second fastening means 13. Furthermore, outside its region of overlap with the second hinge wing 3, the through bore 20, which is associated with the first fastening means 10, is disposed in the contact face 11 of the intermediate part 12.

In the preferred embodiment, the extension 15 of the projection 14 of the intermediate part 12, which projection overlaps or underlaps the other hinge wing, extends roughly in the direction of a bisecting line of the maximally allowed opening angle of the door (generally between 70 and 80 degrees) and is spaced apart from both the hinge axis and the screw bolt 13, which comprises the second fastening means of the intermediate part.

Depending on the design of the door latch, naturally an alignment of the projection 14 of the intermediate part 12, diverges from the one mentioned above, can be provided in such a way, for example, that the extension 15 of the projection 14 is aligned opposite its contact face 11, as viewed in the opening direction, at a greater angle than the bisecting line of the maximally allowed opening angle of the door.

In practical operation, the adaptation of the angle position of the projection 14 to the contact face 11 of the intermediate part 12, depending on the main force directions in the individual case, which result from the geometry of the door coupling, and which forces result from the operation of the door latch, requires an alignment that diverges slightly in the one or the other direction. In particular it can also be provided that the projection 14 of the intermediate part 12 engages the lateral wall of the second hinge wing 3 via a peg or bolt, in an alignment that lies between the second roller and the opening end stop 7 of the catch device of the door latch.

It can be appreciated that the detachable fastening structure requires a minimum number of loose component parts and a minimum expenditure of assembly work time, both for the alignment of doors in the body shell, together with the fastening of the intermediate part or fastening element, and for the reinsertion of the doors.

Further, the structure of the invention guarantees a reliable absorption of the forces, which result from the operation of the door latch, into the hinge fastening. In addition, it should be possible for the structure comprising the door hinge, door latch, and intermediate part or fastening element to be combined into a shipping unit, by means of a retaining clamp, in such a way that no component parts can be lost in shipping.

What is claimed is:

1. A door hinge assembly for car doors, comprising:

first and second hinge wings and a hinge pin for pivotably connecting said wings to each other, said hinge pin defining a hinge axis, said first hinge wing being constructed and arranged to be durably fastened to a door body and said second hinge wing being constructed and arranged to be detachably fastened to a door column, a rotating bar door latch including a retarding and securing member fixed on said first hinge wing, said second hinge wing having a lateral wall projecting perpendicular to the hinge axis, a catch device disposed on said lateral wall of said second hinge wing, an intermediate part cooperable with said second hinge wing for mounting said second hinge wing to the door column, said second hinge wing being formed entirely by a folded pressed sheet metal part and being constructed and arranged to be fastened on the door column via said intermediate part, first fastening means for durably fixing said intermediate part at the door column in a position aligned with said door body said intermediate part including a contact face for engaging the second hinge wing, said contact face being aligned parallel to said hinge axis, said intermediate part including a projection extending perpendicularly to the hinge axis and which receives a portion of said hinge pin, said projection having an extension which engages the lateral wall of the second hinge wing, said extension providing additional support to counteract forces which result from the operation of the door latch, second fastening means for detachably fixing said second hinge wing to the door column said second fastening means effecting connection of the second hinge wing to the intermediate part, and being constructed and arranged to provide common fastening of said intermediate part and said second hinge wing to the door column.

2. The door hinge assembly of claim 1, wherein said member includes a rotating bar spring having an S-shaped load arm.

3. The door hinge assembly of claim 1, wherein said second fastening means comprises a screw bolt.

4. The door hinge assembly of claim 1, wherein when mounted to a car door, said extension of the projection of the intermediate part extends generally in a direction of a bisecting line of a maximally allowed opening angle of the car door and spaced apart from both the hinge axis and the second fastening means.

5. The door hinge assembly of claim 1, wherein the intermediate part is a one-piece part and when viewed from above, has a generally V-shaped outline, wherein one-half of said V-shaped outline is embodied by the contact face on the door column, and the other half of said outline is constituted by the projection and by its extension that adjoins the lateral wall of the second hinge wing.

6. The door hinge assembly of claim 1, wherein said projection, adjacent to the contact face of the intermediate part, has a bore receiving an end region of the hinge pin, said end region protruding from the second hinge wing and engaging with positive fit the lateral wall of the second hinge wing.

7. The door hinge assembly of claim 1, wherein said projection engages the lateral wall of the second hinge wing by means of a peg which is disposed generally axially parallel to the hinge axis.

8. The door hinge assembly of claim 1, wherein said projection has a material thickness which tapers down over its length from a root portion thereof to a free end portion thereof.

9. The door hinge assembly of claim 1, the catch device includes first and second rollers and an end stop, said projection engaging the lateral wall of said second hinge wing in an alignment disposed between the second roller and the end stop.

10. The door hinge assembly of claim 1, wherein said intermediate part includes through holes in said contact face corresponding with the first and the second fastening means, said through holes being slot bores with a long axis thereof being aligned perpendicular to the hinge axis.

11. The door hinge assembly of claim 10, wherein the through bore associated with the first fastening means is disposed in the contact face of the intermediate part, outside an overlapping region with the second hinge wing.

12. The door hinge assembly of claim 10, wherein the second fastening means comprises a screw bolt, said screw bolt constituting the sole fastening means for the second hinge wing, said screw bolt being aligned perpendicular to the hinge axis and reaching through the intermediate part and the door column when the assembly is coupled to the car door, wherein a round bore in the second hinge wing and a slot bore in the intermediate part receive the screw bolt.

13. A door hinge assembly in combination with a car door having a door body and a door column, the assembly comprising:

first and second hinge wings and a hinge pin for pivotably connecting said wings to each other, said hinge pin defining a hinge axis, said first hinge wing being durably fastened to the door body and said second hinge wing being detachably fastened to the door column, a rotating bar door latch including a retarding and securing member fixed on said first hinge wing, said second hinge wing having a lateral wall projecting perpendicular to the hinge axis, a catch device disposed on said lateral wall of said second hinge wing, an intermediate part cooperable with said second hinge wing for mounting said second hinge wing to the door column, said second hinge wing being formed entirely by a folded pressed sheet metal part and being constructed and arranged to be fastened on the door column by means of said intermediate part, first fastening means for durably fixing said intermediate part at the door column in a position aligned with said door body said intermediate part including a contact face for engaging the second hinge wing, said contact face being aligned parallel to said hinge axis, said intermediate part including a projection extending perpendicularly to the hinge axis and which receives portion of said hinge pin, said projection having an extension which engages the lateral wall of the second hinge wing, said extension providing additional support to counteract forces which result from the operation of the door, second fastening means for detachably fixing said second hinge wing to the door column said second fastening means effecting connection of the second hinge wing to the intermediate part, and providing common fastening of intermediate part and said second hinge wing to the door column.

14. A method for assembling a door hinge assembly to a car door, the car door having a door body and a door column, the hinge assembly including first and second hinge wings and a hinge pin for pivotably connecting the wings to each other, said second hinge wing being formed entirely by a folded pressed sheet metal part, said hinge pin defining a hinge axis; a rotating bar door latch including a retarding and securing member fixed on said first hinge wing, said second hinge wing having a lateral wall projecting perpendicular to the hinge axis; a catch device disposed on said lateral wall of said second hinge-wing; and an intermediate part cooperable with said second hinge wing for mounting said second hinge wing to the door column, said intermediate part including a contact face for engaging the second hinge wing, said contact face being aligned parallel to said hinge axis, said intermediate part including a projection aligned perpendicular to the hinge axis and which receives a portion of said hinge pin, said projection having an extension which engages the lateral wall of the second hinge wing, said extension providing additional support to counteract forces which result from the operation of the door latch, the method including:

fixing said intermediate part durably in a pre-aligned, partially secured position on the door column via fastening means, fastening said first hinge wing to the door body, and fastening said second hinge wing to said intermediate part and thus durably fixing said intermediate part and said second hinge wing to said door column via a single fastener.

* * * * *